US008396706B2

(12) United States Patent
Vos

(10) Patent No.: US 8,396,706 B2
(45) Date of Patent: Mar. 12, 2013

(54) SPEECH CODING

(75) Inventor: Koen Bernard Vos, San Francisco, CA (US)

(73) Assignee: Skype, Dublin (IE)

( * ) Notice: Subject to any disclaimer, the term of this patent is extended or adjusted under 35 U.S.C. 154(b) by 888 days.

(21) Appl. No.: 12/455,157

(22) Filed: May 29, 2009

(65) Prior Publication Data

US 2010/0174547 A1 Jul. 8, 2010

(30) Foreign Application Priority Data

Jan. 6, 2009 (GB) ..... 0900144.7

(51) Int. Cl.
*G10L 19/00* (2006.01)

(52) U.S. Cl. ..... 704/219; 704/200; 704/200.1

(58) Field of Classification Search ..... 704/200–230, 704/500–504
See application file for complete search history.

(56) References Cited

U.S. PATENT DOCUMENTS

| | | | |
|---|---|---|---|
| 4,857,927 | A | 8/1989 | Takabayashi |
| 5,125,030 | A | 6/1992 | Nomura et al. |
| 5,240,386 | A | 8/1993 | Amin et al. |
| 5,253,269 | A | 10/1993 | Gerson et al. |
| 5,327,250 | A | 7/1994 | Ikeda |
| 5,357,252 | A | 10/1994 | Ledzius et al. |
| 5,487,086 | A | 1/1996 | Bhaskar |
| 5,646,961 | A | 7/1997 | Shoham et al. |
| 5,649,054 | A | 7/1997 | Oomen et al. |
| 5,680,508 | A | 10/1997 | Liu |
| 5,699,382 | A | 12/1997 | Shoham et al. |
| 5,774,842 | A | 6/1998 | Nishio et al. |
| 5,867,814 | A | 2/1999 | Yong |
| 6,104,992 | A | 8/2000 | Gao et al. |
| 6,122,608 | A | 9/2000 | McCree |
| 6,173,257 | B1 | 1/2001 | Gao |

(Continued)

FOREIGN PATENT DOCUMENTS

| | | |
|---|---|---|
| EP | 0 501 421 A2 | 9/1992 |
| EP | 0550990 | 7/1993 |

(Continued)

OTHER PUBLICATIONS

Lupini, P., et al., "A Multi-Mode Variable Rate Celp Coder Based on Frame Classification," *Proceedings of the International Conference on Communications (ICC), IEEE 1*:406-409 (1993).

(Continued)

*Primary Examiner* — Douglas Godbold
(74) *Attorney, Agent, or Firm* — Wolfe-SBMC

(57) ABSTRACT

A method, system and program for encoding and decoding speech according to a source-filter model whereby speech is modeled to comprise a source signal filtered by a time-varying filter. The method comprises: receiving a speech signal; and from the speech signal, deriving a spectral envelope signal representing the modeled filter and a remaining signal representing the modeled source. At intervals during the encoding, the method further comprises determining a period between portions of the remaining signal having a degree of repetition and determining a correlation between said portions based on that period, thus producing a respective vector of the correlation for each interval. Once every number of said intervals, the method further comprises selecting a codebook from a plurality of codebooks for quantizing the vectors, quantizing the vectors of that number of intervals according to the selected codebook, and transmitting the quantized vectors along with an indication of the selected codebook.

20 Claims, 6 Drawing Sheets

302

| Index | Vector |
|---|---|
| 1 | $C_{LTP,1}=(C_{1,1}, C_{1,2}, \ldots C_{1,i})$ |
| 2 | $C_{LTP,2}=(C_{2,1}, C_{2,2}, \ldots C_{2,i})$ |
| ⋮ | ⋮ |
| M | $C_{LTP,M}=(C_{M,1}, C_{M,2}, \ldots C_{M,i})$ |

U.S. PATENT DOCUMENTS

| | | | | |
|---|---|---|---|---|
| 6,188,980 | B1 | 2/2001 | Thyssen | |
| 6,260,010 | B1 | 7/2001 | Gao et al. | |
| 6,363,119 | B1 | 3/2002 | Oami | |
| 6,408,268 | B1 * | 6/2002 | Tasaki | 704/220 |
| 6,456,964 | B2 * | 9/2002 | Manjunath et al. | 704/205 |
| 6,470,309 | B1 | 10/2002 | McCree | |
| 6,493,665 | B1 | 12/2002 | Su et al. | |
| 6,502,069 | B1 | 12/2002 | Grill et al. | |
| 6,523,002 | B1 | 2/2003 | Gao et al. | |
| 6,574,593 | B1 * | 6/2003 | Gao et al. | 704/222 |
| 6,751,587 | B2 | 6/2004 | Thyssen et al. | |
| 6,757,649 | B1 | 6/2004 | Gao et al. | |
| 6,757,654 | B1 | 6/2004 | Westerlund et al. | |
| 6,775,649 | B1 | 8/2004 | DeMartin | |
| 6,862,567 | B1 | 3/2005 | Gao | |
| 6,996,523 | B1 | 2/2006 | Bhaskar et al. | |
| 7,136,812 | B2 * | 11/2006 | Manjunath et al. | 704/221 |
| 7,149,683 | B2 | 12/2006 | Jelinek | |
| 7,151,802 | B1 | 12/2006 | Bessette et al. | |
| 7,171,355 | B1 | 1/2007 | Chen | |
| 7,496,505 | B2 * | 2/2009 | Manjunath et al. | 704/221 |
| 7,505,594 | B2 | 3/2009 | Mauro | |
| 7,684,981 | B2 | 3/2010 | Thumpudi et al. | |
| 7,869,993 | B2 * | 1/2011 | Ojala | 704/220 |
| 7,873,511 | B2 | 1/2011 | Herre et al. | |
| 8,036,887 | B2 * | 10/2011 | Yasunaga et al. | 704/221 |
| 8,069,040 | B2 | 11/2011 | Vos | |
| 8,078,474 | B2 | 12/2011 | Vos et al. | |
| 2001/0001320 | A1 * | 5/2001 | Heinen et al. | 704/222 |
| 2001/0005822 | A1 | 6/2001 | Fujii et al. | |
| 2001/0039491 | A1 * | 11/2001 | Yasunaga et al. | 704/223 |
| 2002/0032571 | A1 | 3/2002 | Leung et al. | |
| 2002/0099540 | A1 * | 7/2002 | Yasunaga et al. | 704/222 |
| 2002/0120438 | A1 * | 8/2002 | Lin | 704/207 |
| 2003/0200092 | A1 | 10/2003 | Gao et al. | |
| 2004/0102969 | A1 * | 5/2004 | Manjunath et al. | 704/229 |
| 2005/0141721 | A1 | 6/2005 | Aarts et al. | |
| 2005/0278169 | A1 | 12/2005 | Hardwick | |
| 2005/0285765 | A1 | 12/2005 | Suzuki et al. | |
| 2006/0074643 | A1 | 4/2006 | Lee et al. | |
| 2006/0235682 | A1 * | 10/2006 | Yasunaga et al. | 704/223 |
| 2006/0271356 | A1 | 11/2006 | Vos | |
| 2007/0043560 | A1 * | 2/2007 | Lee | 704/219 |
| 2007/0055503 | A1 | 3/2007 | Chu et al. | |
| 2007/0088543 | A1 * | 4/2007 | Ehara | 704/223 |
| 2007/0100613 | A1 * | 5/2007 | Yasunaga et al. | 704/223 |
| 2007/0136057 | A1 | 6/2007 | Phillips | |
| 2007/0225971 | A1 * | 9/2007 | Bessette | 704/203 |
| 2007/0255561 | A1 | 11/2007 | Su et al. | |
| 2008/0004869 | A1 | 1/2008 | Herre et al. | |
| 2008/0015866 | A1 | 1/2008 | Thyssen et al. | |
| 2008/0126084 | A1 | 5/2008 | Lee et al. | |
| 2008/0140426 | A1 | 6/2008 | Kim et al. | |
| 2008/0154588 | A1 | 6/2008 | Gao | |
| 2008/0275698 | A1 * | 11/2008 | Yasunaga et al. | 704/222 |
| 2009/0043574 | A1 * | 2/2009 | Gao et al. | 704/223 |
| 2009/0222273 | A1 * | 9/2009 | Massaloux et al. | 704/500 |
| 2010/0174531 | A1 | 7/2010 | Vos | |
| 2010/0174532 | A1 | 7/2010 | Vos et al. | |
| 2010/0174534 | A1 | 7/2010 | Vos | |
| 2010/0174542 | A1 | 7/2010 | Vos | |
| 2010/0174547 | A1 | 7/2010 | Vos | |
| 2011/0077940 | A1 | 3/2011 | Vos et al. | |
| 2011/0173004 | A1 | 7/2011 | Bessette et al. | |

FOREIGN PATENT DOCUMENTS

| | | | |
|---|---|---|---|
| EP | 0 610 906 | A1 | 8/1994 |
| EP | 0720145 | | 7/1996 |
| EP | 0724252 | | 7/1996 |
| EP | 0849724 | | 6/1998 |
| EP | 0877355 | | 11/1998 |
| EP | 0957472 | | 11/1999 |
| EP | 1093116 | | 4/2001 |
| EP | 1255244 | | 11/2002 |
| EP | 1326235 | | 7/2003 |
| EP | 1758101 | | 2/2007 |
| EP | 1903558 | | 3/2008 |
| GB | 2466669 | | 7/2010 |
| GB | 2466670 | | 7/2010 |
| GB | 2466671 | | 7/2010 |
| GB | 2466672 | | 7/2010 |
| GB | 2466673 | | 7/2010 |
| GB | 2466674 | | 7/2010 |
| GB | 2466675 | | 7/2010 |
| JP | 1205638 | A | 10/1987 |
| JP | 2287400 | A | 4/1989 |
| JP | 4312000 | A | 4/1991 |
| JP | 7306699 | A | 5/1994 |
| JP | 2007279754 | | 10/2007 |
| WO | WO-9103790 | | 3/1991 |
| WO | WO-9403988 | | 2/1994 |
| WO | WO-9518523 | | 7/1995 |
| WO | WO-9918565 | | 4/1999 |
| WO | WO-9963521 | | 12/1999 |
| WO | WO-0103122 | | 1/2001 |
| WO | WO-0191112 | | 11/2001 |
| WO | WO-03052744 | | 6/2003 |
| WO | WO-2005009019 | | 1/2005 |
| WO | WO-2008046492 | | 4/2008 |
| WO | WO-2008056775 | | 5/2008 |
| WO | WO-2010079163 | | 7/2010 |
| WO | WO-2010079164 | | 7/2010 |
| WO | WO-2010079165 | | 7/2010 |
| WO | WO-2010079166 | | 7/2010 |
| WO | WO-2010079167 | | 7/2010 |
| WO | WO-2010079170 | | 7/2010 |
| WO | WO-2010079171 | | 7/2010 |

OTHER PUBLICATIONS

"Wideband Coding of Speech at Around 16 kbit/s Using Adaptive Multi-rate Wideband (AMR-WB)," *International Telecommunication Union G. 722.2*:1-65 (2002).

International Search Report from International Application No. PCT/EP2010/050052, date of mailing Jun. 21, 2010.

Written Opinion of the International Searching Authority from International Application No. PCT/EP2010/050052, date of mailing Jun. 21, 2010.

Search Report of GB 0900144.7, date of mailing Apr. 24, 2009.

"Coding of Speech at 8 kbit/s Using Conjugate-Structure Algebraic-Code-Excited Linear-Prediction (CS-ACELP)", *International Telecommunication Union, ITUT,* (1996), 39 pages.

"International Search Report and Written Opinion", Application No. PCT/EP2010/050060, (Apr. 14, 2010), 14 pages.

"International Search Report and Written Opinion", Application No. PCT/EP2010/050057, (Jun. 24, 2010), 11 pages.

"International Search Report and Written Opinion", Application No. PCT/EP2010/050053, (May 17, 2010), 17 pages.

"International Search Report and Written Opinion", Application No. PCT/EP2010/050061, (Apr. 12, 2010), 13 pages.

"International Search Report and Written Opinion", Application No. PCT/EP2010/050051, (Mar. 15, 2010), 13 pages.

"International Search Report and Written Opinion", Application No. PCT/EP2010/050056, (Mar. 29, 2010), 8 pages.

"Non-Final Office Action", U.S. Appl. No. 12/455,100, (Jun. 8, 2012), 8 pages.

"Non-Final Office Action", U.S. Appl. No. 12/455,632, (Oct. 18, 2011), 14 pages.

"Non-Final Office Action", U.S. Appl. No. 12/455,632, (Feb. 6, 2012), 18 pages.

"Non-Final Office Action", U.S. Appl. No. 12/586,915, (May 8, 2012), 10 pages.

"Notice of Allowance", U.S. Appl. No. 12/455,632, (May 15, 2012), 7 pages.

"Search Report", Application No. GB 0900139.7, (Apr. 17, 2009), 3 pages.

"Search Report", Application No. GB 0900141.3, (Apr. 30, 2009), 3 pages.

"Search Report", Application No. GB 0900142.1, (Apr. 21, 2009), 2 pages.

"Search Report", Application No. GB0900143.9, (Apr. 28, 2009), 1 page.

"Search Report", Application No. GB0900145.4, (Apr. 27, 2009), 1 page.
Bishnu, S et al., "Predictive Coding of Speech Signals and Error Criteria", *IEEE, Transactions on Acoustics, Speech and Signal Processing, ASSP 27*(3),(1979), pp. 247-254.
Chen, Juin-Hwey "Novel Codec Structures for Noise Feedback Coding of Speech", *IEEE*, (2006), pp. 681-684.
Chen, L "Subframe Interpolation Optimized Coding of LSF Parameters", *IEEE*, (Jul. 2007), pp. 725-728.
Denckla, Ben "Subtractive Dither for Internet Audio", *Journal of the Audio Engineering Society*, vol. 46, Issue 7/8, (Jul. 1998), pp. 654-656.
Ferreira, C R., et al., "Modified Interpolation of LSFs Based on Optimization of Distortion Measures", *IEEE*, (Sep. 2006), pp. 777-782.
Gerzon, et al., "A High-Rate Buried-Data Channel for Audio CD", Journal of Audio Engineering Society, vol. 43, No. 1/2,(Jan. 1995), 22 pages.
Haagen, J et al., "Improvements in 2.4 KBPS High-Quality Speech Coding", *IEEE*, (Mar. 1992), pp. 145-148.
Islam, T et al., "Partial-Energy Weighted Interpolation of Linear Prediction Coefficients", *IEEE*, (Sep. 2000), pp. 105-107.
Jayant, N S., et al., "The Application of Dither to the Quantization of Speech Signals", *Program of the 84th Meeting of the Acoustical Society of America.* (Abstract Only, (Nov.-Dec. 1972), pp. 1293-1304.
Mahe, G et al., "Quantization Noise Spectral Shaping in Instantaneous Coding of Spectrally Unbalanced Speech Signals", *IEEE, Speech Coding Workshop*, (2002), pp. 56-58.
Makhoul, John et al., "Adaptive Noise Spectral Shaping and Entropy Coding of Speech", (Feb. 1979), pp. 63-73.
Martins Da Silva, L et al., "Interpolation-Based Differential Vector Coding of Speech LSF Parameters", *IEEE*, (Nov. 1996), pp. 2049-2052.
Rao, A V., et al., "Pitch Adaptive Windows for Improved Excitation Coding in Low-Rate CELP Coders", *IEEE Transactions on Speech and Audio Processing*, (Nov. 2003), pp. 648-659.
Salami, R "Design and Description of CS-ACELP: A Toll Quality 8 kb/s Speech Coder", *IEEE*, 6(2), (Mar. 1998), pp. 116-130.
"Final Office Action", U.S. Appl. No. 12/455,100, (Oct. 4, 2012), 5 pages.
"Final Office Action", U.S. Appl. No. 12/455,478, (Jun. 28, 2012), 8 pages.
"Foreign Office Action", Great Britain Application No. 0900145.4, (May 28, 2012), 2 pages.
"Non-Final Office Action", U.S. Appl. No. 12/455,632, (Aug. 22, 2012), 14 pages.
"Non-Final Office Action", U.S. Appl. No. 12/455,712, (Jun. 20, 2012), 8 pages.
"Non-Final Office Action", U.S. Appl. No. 12/455,752, (Jun. 15, 2012), 8 pages.
"Non-Final Office Action", U.S. Appl. No. 12/583,998, (Oct. 18, 2012), 16 pages.
"Non-Final Office Action", U.S. Appl. No. 12/586,915, (Sep. 25, 2012), 10 pages.
"Notice of Allowance", U.S. Appl. No. 12/455,712, (Oct. 23, 2012), 7 pages.
"Examination Report", GB Application No. 0900141.3, (Oct. 8, 2012), 2 pages.
"Final Office Action", U.S. Appl. No. 12/455,752, (Nov. 23, 2012), 8 pages.
"Notice of Allowance", U.S. Appl. No. 12/455,478, (Dec. 7, 2012), 7 pages.
"Supplemental Notice of Allowance", U.S. Appl. No. 12/455,712, (Dec. 19, 2012), 2 pages.
"Examination Report under Section 18(3)", Great Britain Application No. 0900143.9, (May 21, 2012), 2 pages.
"Examination Report", GB Application No. 0900140.5, (Aug. 29, 2012), 3 pages.
"Search Report", GB Application No. 0900140.5, (May 5, 2009), 3 pages.
"Final Office Action", U.S. Appl. No. 12/455,632, (Jan. 18, 2013), 15 pages.
"Notice of Allowance", U.S. Appl. No. 12/586,915, (Jan. 22, 2013), 8 pages.
"Supplemental Notice of Allowance", U.S. Appl. No. 12/455,478, (Jan. 11, 2013), 2 pages.
"Supplemental Notice of Allowance", U.S. Appl. No. 12/455,712, (Jan. 14, 2013), 2 pages.

* cited by examiner

302

| Index | Vector |
|---|---|
| 1 | $C_{LTP,1}=(C_{1,1}, C_{1,2}, \ldots C_{1,i})$ |
| 2 | $C_{LTP,2}=(C_{2,1}, C_{2,2}, \ldots C_{2,i})$ |
| ⋮ | ⋮ |
| M | $C_{LTP,M}=(C_{M,1}, C_{M,2}, \ldots C_{M,i})$ |

SPEECH CODING

RELATED APPLICATION

This application claims priority under 35 U.S.C. §119 or 365 to Great Britain Application No. 0900144.7, filed Jan. 6, 2009. The entire teachings of the above application are incorporated herein by reference.

FIELD OF THE INVENTION

The present invention relates to the encoding of speech for transmission over a transmission medium, such as by means of an electronic signal over a wired connection or electromagnetic signal over a wireless connection.

BACKGROUND

A source-filter model of speech is illustrated schematically in FIG. 1*a*. As shown, speech can be modelled as comprising a signal from a source 102 passed through a time-varying filter 104. The source signal represents the immediate vibration of the vocal chords, and the filter represents the acoustic effect of the vocal tract formed by the shape of the throat, mouth and tongue. The effect of the filter is to alter the frequency profile of the source signal so as to emphasise or diminish certain frequencies. Instead of trying to directly represent an actual waveform, speech encoding works by representing the speech using parameters of a source-filter model.

As illustrated schematically in FIG. 1*b*, the encoded signal will be divided into a plurality of frames 106, with each frame comprising a plurality of subframes 108. For example, speech may be sampled at 16 kHz and processed in frames of 20 ms, with some of the processing done in subframes of 5 ms (four subframes per frame). Each frame comprises a flag 107 by which it is classed according to its respective type. Each frame is thus classed at least as either "voiced" or "unvoiced", and unvoiced frames are encoded differently than voiced frames. Each subframe 108 then comprises a set of parameters of the source-filter model representative of the sound of the speech in that subframe.

For voiced sounds (e.g. vowel sounds), the source signal has a degree of long-term periodicity corresponding to the perceived pitch of the voice. In that case, the source signal can be modelled as comprising a quasi-periodic signal, with each period corresponding to a respective "pitch pulse" comprising a series of peaks of differing amplitudes. The source signal is said to be "quasi" periodic in that on a timescale of at least one subframe it can be taken to have a single, meaningful period which is approximately constant; but over many subframes or frames then the period and form of the signal may change. The approximated period at any given point may be referred to as the pitch lag. An example of a modelled source signal 202 is shown schematically in FIG. 2*a* with a gradually varying period $P_1$, $P_2$, $P_3$, etc., each comprising a pitch pulse of four peaks which may vary gradually in form and amplitude from one period to the next.

According to many speech coding algorithms such as those using Linear Predictive Coding (LPC), a short-term filter is used to separate out the speech signal into two separate components: (i) a signal representative of the effect of the time-varying filter 104; and (ii) the remaining signal with the effect of the filter 104 removed, which is representative of the source signal. The signal representative of the effect of the filter 104 may be referred to as the spectral envelope signal, and typically comprises a series of sets of LPC parameters describing the spectral envelope at each stage. FIG. 2*b* shows a schematic example of a sequence of spectral envelopes $\mathbf{204}_1$, $\mathbf{204}_2$, $\mathbf{204}_3$, etc. varying over time. Once the varying spectral envelope is removed, the remaining signal representative of the source alone may be referred to as the LPC residual signal, as shown schematically in FIG. 2*a*. The short-term filter works by removing short-term correlations (i.e. short term compared to the pitch period), leading to an LPC residual with less energy than the speech signal.

The spectral envelope signal and the source signal are each encoded separately for transmission. In the illustrated example, each subframe 106 would contain: (i) a set of parameters representing the spectral envelope 204; and (ii) an LPC residual signal representing the source signal 202 with the effect of the short-term correlations removed.

To improve the encoding of the source signal, its periodicity may be exploited. To do this, a long-term prediction (LTP) analysis is used to determine the correlation of the LPC residual signal with itself from one period to the next, i.e. the correlation between the LPC residual signal at the current time and the LPC residual signal after one period at the current pitch lag (correlation being a statistical measure of a degree of relationship between groups of data, in this case the degree of repetition between portions of a signal). In this context the source signal can be said to be "quasi" periodic in that on a timescale of at least one correlation calculation it can be taken to have a meaningful period which is approximately (but not exactly) constant; but over many such calculations then the period and form of the source signal may change more significantly. A set of parameters derived from this correlation are determined to at least partially represent the source signal for each subframe. The set of parameters for each subframe is typically a set of coefficients C of a series, which form a respective vector $C_{LTP}=(C_1, C_2, \ldots C_i)$.

The effect of this inter-period correlation is then removed from the LPC residual, leaving an LTP residual signal representing the source signal with the effect of the correlation between pitch periods removed. To represent the source signal, the LTP vectors and LTP residual signal are encoded separately for transmission.

The sets of LPC parameters, the LTP vectors and the LTP residual signal are each quantized prior to transmission (quantization being the process of converting a continuous range of values into a set of discrete values, or a larger approximately continuous set of discrete values into a smaller set of discrete values). The advantage of separating out the LPC residual signal into the LTP vectors and LTP residual signal is that the LTP residual typically has a lower energy than the LPC residual, and so requires fewer bits to quantize.

So in the illustrated example, each subframe 106 would comprise: (i) a quantised set of LPC parameters representing the spectral envelope, (ii)(a) a quantised LTP vector related to the correlation between pitch periods in the source signal, and (ii)(b) a quantised LTP residual signal representative of the source signal with the effects of this inter-period correlation removed.

To compress the LTP vectors for transmission, they are quantized according to a vector quantization. This is done using a predetermined codebook comprising a plurality of discrete, predetermined vectors each being allocated a corresponding index. The vector quantization process then involves determining which of the predetermined vectors the vector being quantized is most similar to, and then representing that vector using the corresponding index from the codebook. An example codebook 302 having M entries each with a vector of i parameters is shown schematically in FIG. 3. The codebook is known to both the encoder and decoder. Thus only a single codebook index is needed to encode a vector, rather than the actual values of the parameters making up the vector. This therefore requires fewer bits to encode, and so reduces transmission overhead.

However, it would be desirable to further improve the quantization of encoding schemes such as LTP which encode speech using a correlation between approximately periodic portions of a source signal of a source-filter model.

SUMMARY

According to one aspect of the present invention, there is provided a method of encoding speech according to a source-filter model whereby speech is modelled to comprise a source signal filtered by a time-varying filter, the method comprising: receiving a speech signal; from the speech signal, deriving a spectral envelope signal representative of the modelled filter and a first remaining signal representative of the modelled source signal; at each of a plurality of intervals during the encoding, determining a period between portions of the first remaining signal having a degree of repetition and determining a correlation between said portions based on said period, thus producing a respective vector of the correlation for each interval, each vector comprising a plurality of parameters derived from the respective correlation; once every number of said intervals, selecting a codebook from a plurality of codebooks for quantizing said vectors, quantizing the vectors of that number of intervals according to the selected codebook, and transmitting the quantized vectors along with an indication of the selected codebook over a transmission medium as part of an encoded signal representative of said speech signal.

In embodiments, the selection may comprise quantizing at least one of the vectors of said number of intervals according to each of said plurality of codebooks, and selecting a codebook based on comparison of said quantizations.

The selection may comprise quantizing all of the vectors of said number of intervals according to each of said plurality of codebooks, and selecting a codebook based on comparison of said quantizations.

The selection may be based on comparison of a distortion measure evaluated for the vectors of said number of intervals as quantized according to each of said codebooks.

The comparison may be based on the distortion measure weighed against a bitrate required to encode the vectors of said number of intervals according to each codebook.

The encoding may be performed over a plurality of frames, each frame comprising a plurality of subframes; each of said intervals may be a subframe; and said number may be the number of subframes per frame such that said selection is performed once per frame. Alternatively, said number may be one.

The method may further comprise: extracting a signal comprising said vectors from the first remaining signal, thus leaving a second remaining signal; and transmitting parameters of the second remaining signal over the communication medium as part of said encoded signal The extraction of said second remaining signal from the first remaining signal may be by long term prediction.

The derivation of said first remaining signal from the speech signal may be by linear predictive coding.

According to another aspect of the present invention, there is provided a method of decoding an encoded signal comprising speech encoded according to a source-filter model whereby the speech is modelled to comprise a source signal filtered by a time-varying filter, the method comprising: receiving a encoded signal over a communication medium; at intervals during the decoding of said encoded signal, determining an index of a respective quantized vector from the encoded signal, each vector relating to a correlation between portions of the modelled source signal having a degree of repetition; once every number of said intervals, determining an indicator of a codebook from the encoded signal, selecting the indicated codebook from a plurality of codebooks said vectors, and using the selected codebook to determine the vectors of said number of intervals from their respective indices; generating a decoded speech signal based on the determined vectors, and outputting the decoded speech signal to an output device.

According to another aspect of the present invention, there is provided an encoder for encoding speech according to a source-filter model whereby speech is modelled to comprise a source signal filtered by a time-varying filter, the encoder comprising: an input arranged to receive a speech signal; a first signal-processing module configured to derive, from the speech signal, a spectral envelope signal representative of the modelled filter and a first remaining signal representative of the modelled source signal; a second signal-processing module configured to determine, at each of a plurality of intervals during the encoding, a period between portions of the first remaining signal having a degree of repetition and determine a correlation between said portions based on said period, thus producing a respective vector of the correlation for each interval, each vector comprising a plurality of parameters derived from the respective correlation; wherein the second signal-processing module is further configured to select, once every number of said intervals, a codebook from a plurality of codebooks for quantizing said vectors, to quantize the vectors of that number of intervals according to the selected codebook, and to transmit the quantized vectors along with an indication of the selected codebook over a transmission medium as part of an encoded signal representative of said speech signal.

According to another aspect of the present invention, there is provided a decoder for decoding an encoded signal comprising speech encoded according to a source-filter model whereby the speech is modelled to comprise a source signal filtered by a time-varying filter, the decoder comprising: an input module for receiving an encoded signal over a communication medium; and a signal-processing module configured to determine, at intervals during the decoding of said encoded signal, an index of a respective quantized vector from the encoded signal, each vector relating to a correlation between portions of the modelled source signal having a degree of repetition; wherein the signal-processing module is further configured to determine, once every number of said intervals, an indicator of a codebook from the encoded signal, to select the indicated codebook from a plurality of codebooks said vectors, and to use the selected codebook to determine the vectors of said number of intervals from their respective indices; and the decoder further comprises an output module configured to generate a decoded speech signal based on the determined vectors, and output the decoded speech signal to an output device.

According to another aspect of the present invention, there is provided a computer program product for encoding speech according to a source-filter model whereby the speech is modelled to comprise a source signal filtered by a time-varying filter, the program comprising code arranged so as when executed on a processor to:

receive a speech signal;

from the speech signal, derive a spectral envelope signal representative of the modelled filter and a first remaining signal representative of the modelled source signal;

at each of a plurality of intervals during the encoding, determine a period between portions of the first remaining signal having a degree of repetition and determine a correlation between said portions based on said period, thus producing a respective vector of the correlation for each interval, each vector comprising a plurality of parameters derived from the respective correlation;

once every number of said intervals, select a codebook from a plurality of codebooks for quantizing said vectors, quantize the vectors of that number of intervals according to the selected codebook, and transmit the quantized vectors along with an indication of the selected codebook over a transmission medium as part of an encoded signal representative of said speech signal.

According to another aspect of the present invention, there is provided a computer program product for decoding an encoded signal comprising speech encoded according to a source-filter model whereby the speech is modelled to comprise a source signal filtered by a time-varying filter, the program comprising code arranged so as when executed on a processor to:

receive an encoded signal over a communication medium;

at intervals during the decoding of said encoded signal, determine an index of a respective quantized vector from the encoded signal, each vector relating to a correlation between portions of the modelled source signal having a degree of repetition;

once every number of said intervals, determine an indicator of a codebook from the encoded signal, select the indicated codebook from a plurality of codebooks said vectors, and use the selected codebook to determine the vectors of said number of intervals from their respective indices; and generate a decoded speech signal based on the determined vectors, and outputting the decoded speech signal to an output device.

According to further aspects of the present invention, there are provided corresponding computer program products such as client application products.

According to another aspect of the present invention, there is provided a communication system comprising a plurality of end-user terminals each comprising a corresponding encoder and/or decoder.

BRIEF DESCRIPTION OF THE DRAWINGS

For a better understanding of the present invention and to show how it may be carried into effect, reference will now be made by way of example to the accompanying drawings in which.

DETAILED DESCRIPTION OF PREFERRED EMBODIMENTS

Figure 1A:
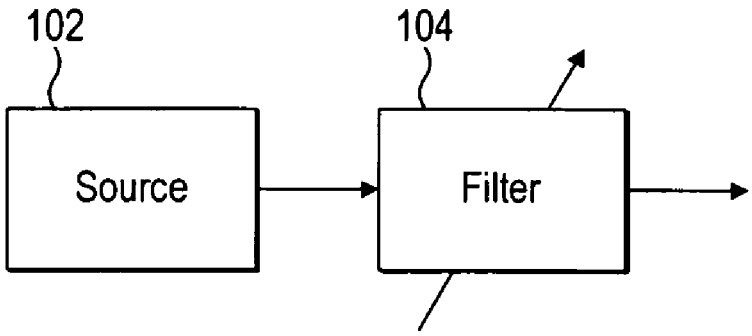
FIG. 1*a* is a schematic representation of a source-filter model of speech.

Long-term prediction (LTP) is a common technique in speech coding, whereby correlations between pitch pulses are exploited to improve coding efficiency. In the encoder, an LTP analysis filter uses one or more pitch lags and one or more LTP coefficients to compute an LTP residual signal from an LPC residual. The LTP residual has smaller variance and can thus be encoded more efficiently than the LPC residual. The pitch lags and LTP coefficients are sent to the decoder together with the coded LTP residual, and used to construct the speech output signal.

In order to minimize the LTP residual, it is advantageous to update the LTP coefficients frequently. Typically, new coefficients are defined for every subframe of 5 or 10 milliseconds. However, transmitting quantized LTP coefficients comes at a cost in bitrate, as it typically takes 4 to 6 bits to encode one LTP vector.

One approach to reducing the bitrate is to jointly quantize the LTP coefficients for all subframes with a single vector quantizer. However, such a vector quantizer uses a large codebook of thousands of codebook vectors, requiring a large amount of ROM storage and incurring a high cost in computation complexity.

In preferred embodiments, the present invention provides a method of encoding a speech signal using multiple vector quantization codebooks for quantizing long-term prediction coefficients, and selecting an LTP quantization codebook out of multiple LTP quantization codebooks to quantize multiple LTP vectors.

For frames classified as voiced, a long-term prediction (LTP) filter reduces the energy of the linear prediction coding (LPC) residual. The resulting LTP residual can be quantized and coded more efficiently than the LPC residual. The LTP filter is preferably a five-tap filter for which the coefficients are found in an LTP analysis. Since the decoder needs to apply an inverse LTP filtering to construct the decoded speech signal, the LTP filter coefficients are quantized and transmitted to the decoder. The LTP coefficients are updated every subframe, where four subframes are contained in a frame, and in each subframe five LTP coefficients are specified.

The LTP coefficients for each subframe are quantized using Entropy Constrained Vector Quantization. A total of three vector codebooks are available for quantization, with difference rate-distortion trade-offs. The three codebooks have 10, 20 and 40 vectors and average rates of about 3, 4, and 5 bits per vector, respectively. The codebook search for the subframe LTP vectors is constrained to only allow codebook vectors that are chosen from the same codebook.

To find the best codebook, each of the three vector codebooks is used to quantize each subframe LTP vector and produce a weighted rate-distortion measure, and the vector codebook with the lowest combined rate-distortion over all subframes is chosen. The quantized LTP vectors are used in the noise shaping quantizer, and the index of the codebook plus the four indices for the four subframe codebook vectors are entropy coded and sent to the decoder.

Selecting and indicating one of several smaller codebooks to quantize multiple LTP vectors leads to a lower bitrate than using one large codebook. If the large codebook were to be constructed from the several smaller codebooks, then a method to encode the quantization index for an LTP vector would be to first indicate one of the smaller codebooks and subsequently index a vector in the indicated smaller codebook. This encoding method uses a codebook indicator for every LTP vector. The preferred method of the present invention, however, uses only one codebook indicator for all LTP vectors in a frame. This results in a lower bitrate.

Using the same codebook for quantizing multiple LTP vectors in a frame puts a constraint on the codebook vectors that can be used to represent different LTP vectors. However, this has little impact on quantization performance because which codebook is most efficient for quantizing an LTP vector depends on the periodicity of the speech signal and the change in pitch pulse amplitude. Both these aspects are typically almost constant during a frame for speech. Consequently, one codebook can usually efficiently encode all LTP vectors in a frame.

Figure 1B:
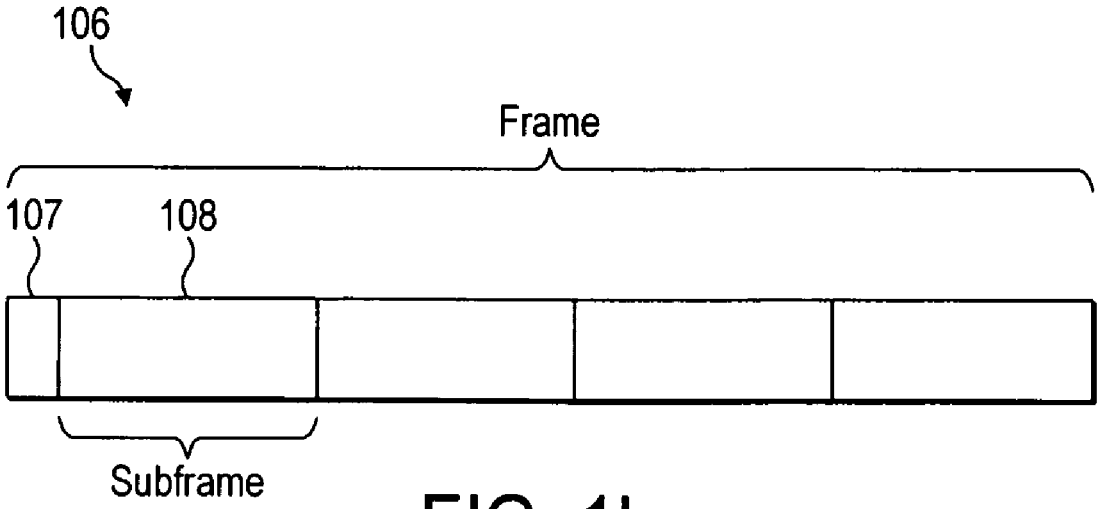
FIG. 1*b* is a schematic representation of a frame
Figure 2A:
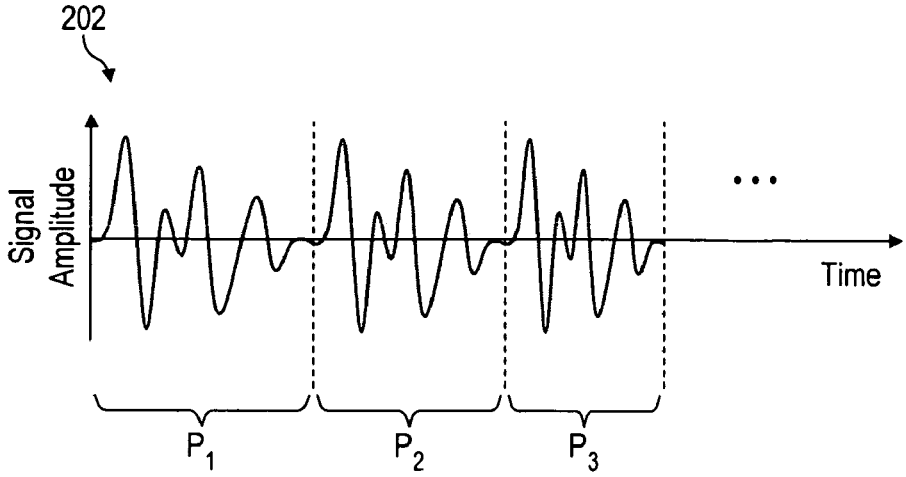
FIG. 2*a* is a schematic representation of a source signal
Figure 2B:
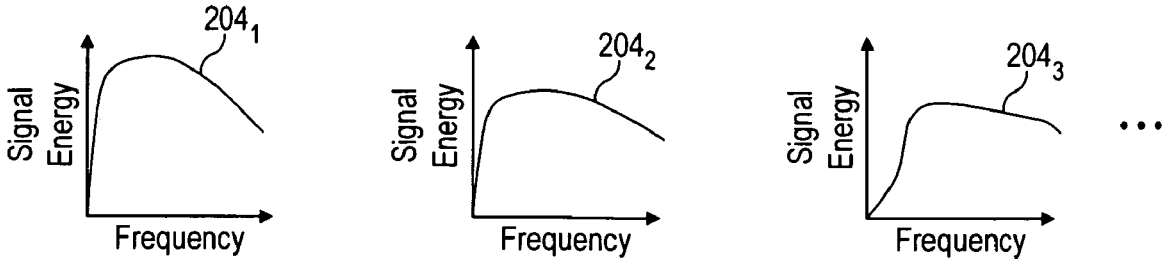
FIG. 2*b* is a schematic representation of variations in a spectral envelope.
Figures 3, 4:
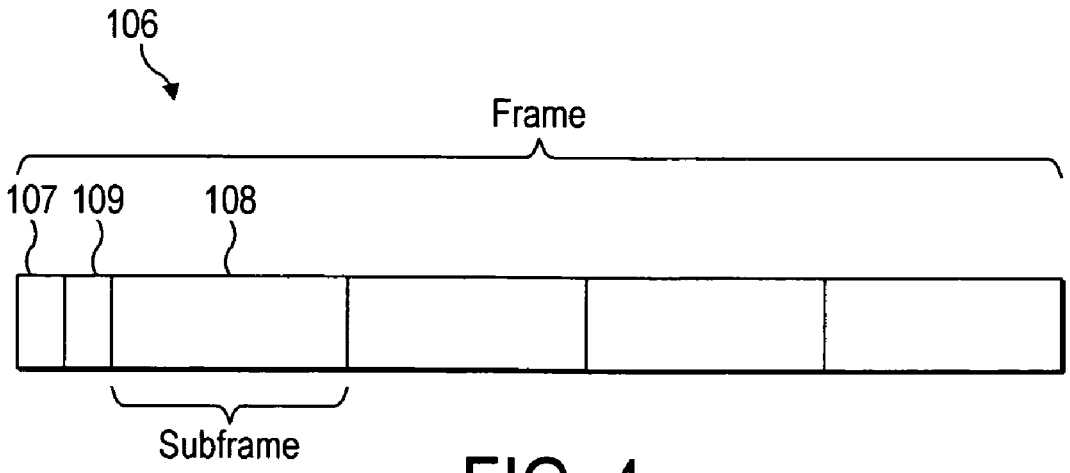
FIG. 3 is a schematic representation of a codebook for quantising vectors.
FIG. 4 is another schematic representation of a frame.

FIG. 4 is a schematic representation of a frame according to a preferred embodiment of the present invention. In addition to the classification flag 107 and subframes 108 as discussed in relation to FIG. 1*b*, the frame additionally comprises an indicator 109 of the codebook selected to quantize the vectors of that frame.

Figure 5:
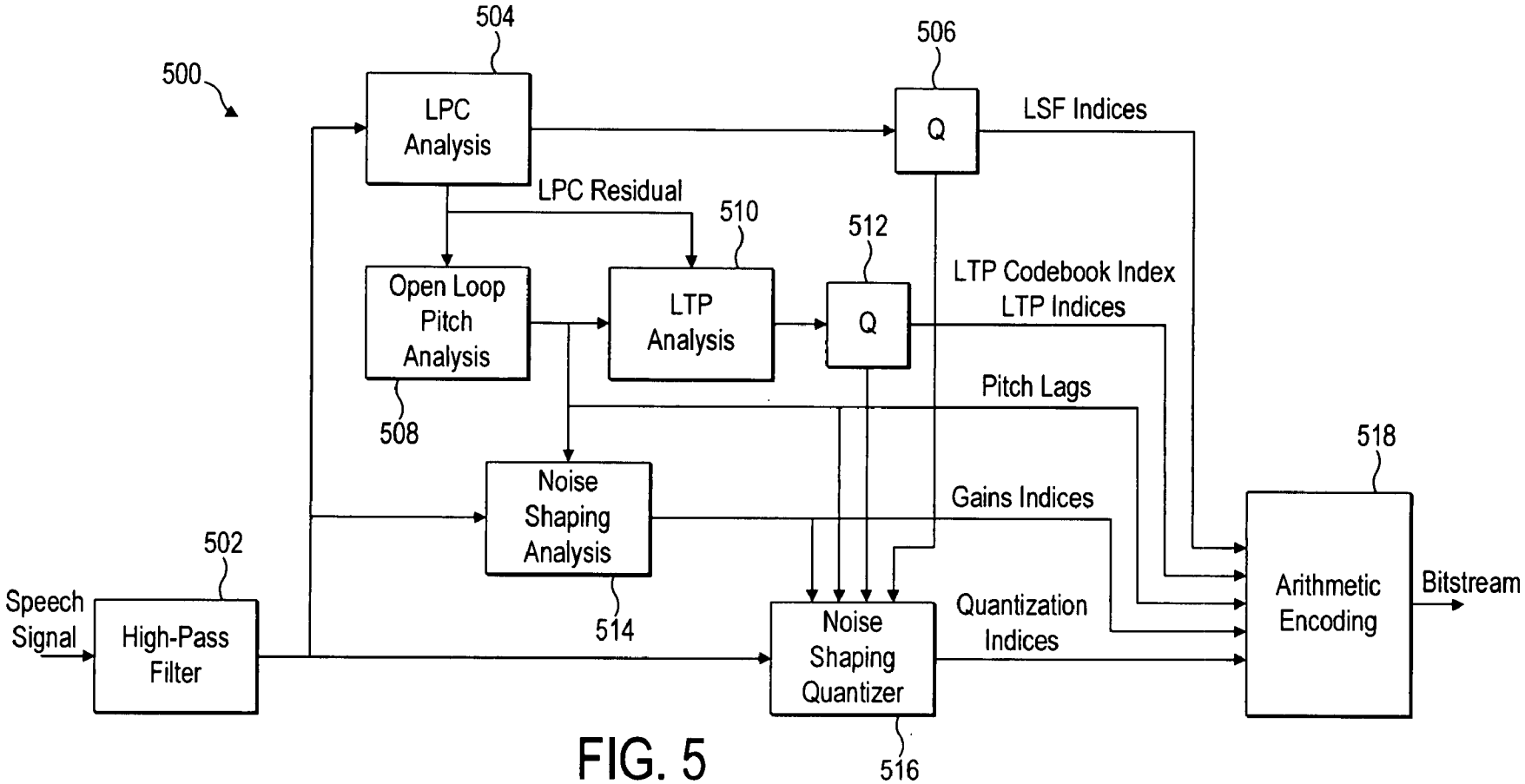
FIG. 5 is a schematic block diagram of an encoder.

An example of an encoder 500 for implementing the present invention is now described in relation to FIG. 5.

The encoder 500 comprises a high-pass filter 502, a linear predictive coding (LPC) analysis block 504, a first vector quantizer 506, an open-loop pitch analysis block 508, a long-term prediction (LTP) analysis block 510, a second vector quantizer 512, a noise shaping analysis block 514, a noise shaping quantizer 516, and an arithmetic encoding block 518. The high pass filter 502 has an input arranged to receive an input speech signal from an input device such as a microphone, and an output coupled to inputs of the LPC analysis block 504, noise shaping analysis block 514 and noise shaping quantizer 516. The LPC analysis block has an output coupled to an input of the first vector quantizer 506, and the first vector quantizer 506 has outputs coupled to inputs of the arithmetic encoding block 518 and noise shaping quantizer 516. The LPC analysis block 504 has outputs coupled to inputs of the open-loop pitch analysis block 508 and the LTP analysis block 510. The LTP analysis block 510 has an output coupled to an input of the second vector quantizer 512, and the second vector quantizer 512 has outputs coupled to inputs of the arithmetic encoding block 518 and noise shaping quantizer 516. The open-loop pitch analysis block 508 has outputs coupled to inputs of the LTP 510 analysis block 510 and the noise shaping analysis block 514. The noise shaping analysis block 514 has outputs coupled to inputs of the arithmetic encoding block 518 and the noise shaping quantizer 516. The noise shaping quantizer 516 has an output coupled to an input of the arithmetic encoding block 518. The arithmetic encoding block 518 is arranged to produce an output bitstream based on its inputs, for transmission from an output device such as a wired modem or wireless transceiver.

In operation, the encoder processes a speech input signal sampled at 16 kHz in frames of 20 milliseconds, with some of the processing done in subframes of 5 milliseconds. The output bitsream payload contains arithmetically encoded parameters, and has a bitrate that varies depending on a quality setting provided to the encoder and on the complexity and perceptual importance of the input signal.

The speech input signal is input to the high-pass filter 504 to remove frequencies below 80 Hz which contain almost no speech energy and may contain noise that can be detrimental to the coding efficiency and cause artifacts in the decoded output signal. The high-pass filter 504 is preferably a second order auto-regressive moving average (ARMA) filter.

The high-pass filtered input $x_{HP}$ is input to the linear prediction coding (LPC) analysis block 504, which calculates 16 LPC coefficients $a_i$ using the covariance method which minimizes the energy of the LPC residual $r_{LPC}$:

$$r_{LPC}(n) = x_{HP}(n) - \sum_{i=1}^{16} x_{HP}(n-i)a_i,$$

where n is the sample number. The LPC coefficients are used with an LPC analysis filter to create the LPC residual.

The LPC coefficients are transformed to a line spectral frequency (LSF) vector. The LSFs are quantized using the first vector quantizer 506, a multi-stage vector quantizer (MSVQ) with 10 stages, producing 10 LSF indices that together represent the quantized LSFs. The quantized LSFs are transformed back to produce the quantized LPC coefficients for use in the noise shaping quantizer 516.

The LPC residual is input to the open loop pitch analysis block 508, producing one pitch lag for every 5 millisecond subframe, i.e., four pitch lags per frame. The pitch lags are chosen between 32 and 288 samples, corresponding to pitch frequencies from 56 to 500 Hz, which covers the range found in typical speech signals. Also, the pitch analysis produces a pitch correlation value which is the normalized correlation of the signal in the current frame and the signal delayed by the pitch lag values. Frames for which the correlation value is below a threshold of 0.5 are classified as unvoiced, i.e., containing no periodic signal, whereas all other frames are classified as voiced. The pitch lags are input to the arithmetic coder 518 and noise shaping quantizer 516.

For voiced frames, a long-term prediction analysis is performed on the LPC residual. The LPC residual $r_{LPC}$ is supplied from the LPC analysis block 504 to the LTP analysis block 510. For each subframe, the LTP analysis block 510 solves normal equations to find 5 linear prediction filter coefficients $b_i$ such that the energy in the LTP residual $r_{LTP}$ for that subframe:

$$r_{LTP}(n) = r_{LPC}(n) - \sum_{i=-2}^{2} r_{LPC}(n - \text{lag} - i)b_i$$

is minimized. The normal equations are solved as:

$$b = W_{LTP}^{-1} C_{LTP},$$

where $W_{LTP}$ is a weighting matrix containing correlation values $$W_{LTP}(i, j) = \sum_{n=0}^{79} r_{LPC}(n + 2 - \text{lag} - i) r_{LPC}(n + 2 - \text{lag} - j),$$

and $C_{LTP}$ is a correlation vector:

$$C_{LTP}(i) = \sum_{n=0}^{79} r_{LPC}(n) r_{LPC}(n + 2 - \text{lag} - i).$$

For voiced frames, the prediction analysis described above results in four sets (one set per subframe) of five LTP coefficients, plus four weighting matrices. The LTP coefficients for each subframe are quantized using Entropy Constrained Vector Quantization. A total of three vector codebooks are available for quantization, with different rate-distortion trade-offs. The three codebooks have 10, 20 and 40 vectors and average rates of about 3, 4, and 5 bits per vector, respectively. Consequently, the first codebook has larger average quantization distortion at a lower rate, whereas the last codebook has smaller average quantization distortion at a higher rate.

The energy of the LTP residual is computed as $$E_{LTP} = \sum_{n=0}^{79} r_{LTP}(n)^2,$$

and used to create the normalized weighting matrix $W_{LTP,norm}$ $$W_{LTP,norm} = \frac{W_{LTP}}{E_{LTP}}.$$

Given the weighting matrix $W_{LTP,norm}$, LTP residual energy $E_{LTP}$ and LTP vector b, the weighted rate-distortion measure for a codebook vector $cb_i$ with rate $r_i$ is give by:

$$RD=u(b-cb_j)^T W_{LTP,norm}(b-cb_j)+r_j,$$

where u is a fixed, heuristically determined parameter balancing the distortion and rate. Which codebook gives the best performance for a given LTP vector depends on the normalized weighting matrix for that LTP vector. For example, for a small $W_{LTP,norm}$, it is advantageous to use the codebook with 10 vectors as it has a lower average rate. For a large $W_{LTP,norm}$, on the other hand, it is often better to use the codebook with 40 vectors, as it is more likely to contain a codebook vector resulting in a small distortion.

The normalized weighting matrix $W_{LTP,norm}$ depends mostly on two aspects of the input signal. The first is the periodicity of the signal; the more periodic the larger $W_{LTP,norm}$. The second is the change in signal energy in the current subframe, relative to the signal one pitch lag earlier. A decaying energy leads to a larger $W_{LTP,norm}$ than an increasing energy. Both aspects do not fluctuate very fast which causes the $W_{LTP,norm}$ matrices for different subframes of one frame often to be similar. As a result, typically one of the three codebooks gives good performance for all subframes. Therefore the codebook search for the subframe LTP vectors is constrained to only allow codebook vectors that are chosen from the same codebook, which results in a rate reduction.

To find the best codebook, each of the three vector codebooks is used to quantize each subframe LTP vector and produce a weighted rate-distortion measure, and the vector codebook with the lowest combined rate-distortion over all subframes is chosen. The quantized LTP vectors are used in the noise shaping quantizer 516, and the index of the codebook plus the four indices for the four subframe codebook vectors are entropy coded and sent to the decoder.

The high-pass filtered input is analyzed by the noise shaping analysis block 514 to find filter coefficients and quantization gains used in the noise shaping quantizer. The filter coefficients determine the distribution over the quantization noise over the spectrum, and are chose such that the quantization is least audible. The quantization gains determine the step size of the residual quantizer and as such govern the balance between bitrate and quantization noise level.

All noise shaping parameters are computed and applied per subframe of 5 milliseconds. First, a $16^{th}$ order noise shaping LPC analysis is performed on a windowed signal block of 16 milliseconds. The signal block has a look-ahead of 5 milliseconds relative to the current subframe, and the window is an asymmetric sine window. The noise shaping LPC analysis is done with the autocorrelation method. The quantization gain is found as the square-root of the residual energy from the noise shaping LPC analysis, multiplied by a constant to set the average bitrate to the desired level. For voiced frames, the quantization gain is further multiplied by 0.5 times the inverse of the pitch correlation determined by the pitch analyses, to reduce the level of quantization noise which is more easily audible for voiced signals. The quantization gain for each subframe is quantized, and the quantization indices are input to the arithmetically encoder 518. The quantized quantization gains are input to the noise shaping quantizer 516.

Next a set of short-term noise shaping coefficients $a_{shape,i}$ are found by applying bandwidth expansion to the coefficients found in the noise shaping LPC analysis. This bandwidth expansion moves the roots of the noise shaping LPC polynomial towards the origin, according to the formula:

$$a_{shape,i}=a_{autocorr,i}\,g^i$$

where $a_{autocorr,i}$ is the ith coefficient from the noise shaping LPC analysis and for the bandwidth expansion factor g a value of 0.94 was found to give good results.

For voiced frames, the noise shaping quantizer also applies long-term noise shaping. It uses three filter taps, described by:

$$b_{shape}=0.5\text{sqrt}(\text{PitchCorrelation})\ [0.25, 0.5, 0.25].$$

The short-term and long-term noise shaping coefficients are input to the noise shaping quantizer 516. The high-pass filtered input is also input to the noise shaping quantizer 516.

Figure 6:
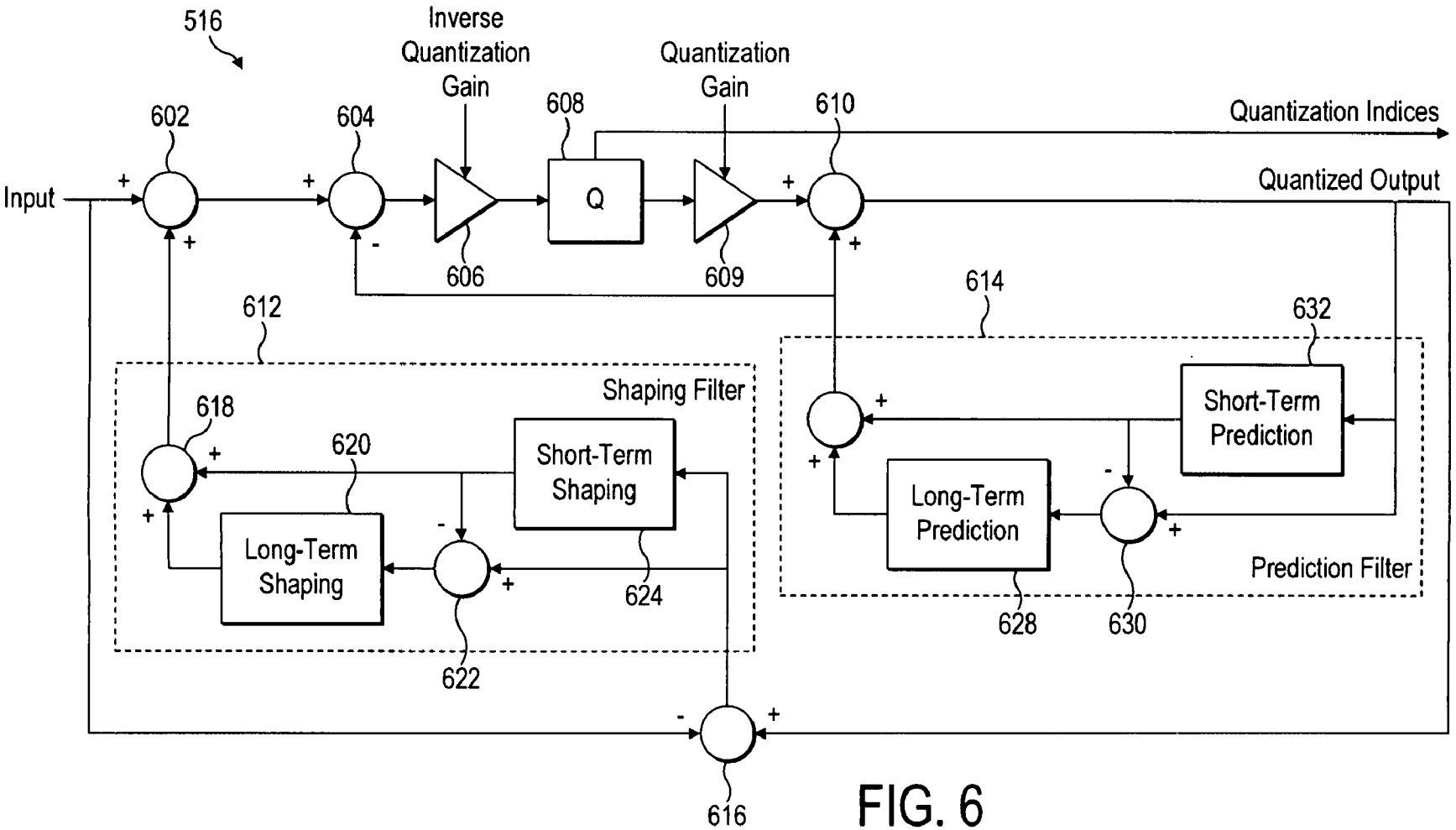
FIG. 6 is a schematic block diagram of a noise shaping quantizer.

An example of the noise shaping quantizer 516 is now discussed in relation to FIG. 6.

The noise shaping quantizer 516 comprises a first addition stage 602, a first subtraction stage 604, a first amplifier 606, a scalar quantizer 608, a second amplifier 609, a second addition stage 610, a shaping filter 612, a prediction filter 614 and a second subtraction stage 616. The shaping filter 612 comprises a third addition stage 618, a long-term shaping block 620, a third subtraction stage 622, and a short-term shaping block 624. The prediction filter 614 comprises a fourth addition stage 626, a long-term prediction block 628, a fourth subtraction stage 630, and a short-term prediction block 632.

The first addition stage 602 has an input arranged to receive the high-pass filtered input from the high-pass filter 502, and another input coupled to an output of the third addition stage 618. The first subtraction stage has inputs coupled to outputs of the first addition stage 602 and fourth addition stage 626. The first amplifier has a signal input coupled to an output of the first subtraction stage and an output coupled to an input of the scalar quantizer 608. The first amplifier 606 also has a control input coupled to the output of the noise shaping analysis block 514. The scalar quantizer 608 has outputs coupled to inputs of the second amplifier 609 and the arithmetic encoding block 518. The second amplifier 609 also has a control input coupled to the output of the noise shaping analysis block 514, and an output coupled to the an input of the second addition stage 610. The other input of the second addition stage 610 is coupled to an output of the fourth addition stage 626. An output of the second addition stage is coupled back to the input of the first addition stage 602, and to an input of the short-term prediction block 632 and the fourth subtraction stage 630. An output of the short-term prediction block 632 is coupled to the other input of the fourth subtraction stage 630. The output of the fourth subtraction stage 630 is coupled to the input of the long-term prediction block 628. The fourth addition stage 626 has inputs coupled to outputs of the long-term prediction block 628 and short-term prediction block 632. The output of the second addition stage 610 is further coupled to an input of the second subtraction stage 616, and the other input of the second subtraction stage 616 is coupled to the input from the high-pass filter 502. An output of the second subtraction stage 616 is coupled to inputs of the short-term shaping block 624 and the third subtraction stage 622. An output of the short-term shaping block 624 is coupled to the other input of the third subtraction stage 622. The output of third subtraction stage 622 is coupled to the input of the long-term shaping block 620. The third addition stage 618 has inputs coupled to outputs of the long-term shaping block 620 and short-term shaping block 624. The short-term and long-term shaping blocks 624 and 620 are each also coupled to the noise shaping analysis block 514, and the long-term shaping block 620 is also coupled to the open-loop pitch analysis block 508 (connections not shown). Further, the short-term prediction block 632 is coupled to the LPC analysis block 504 via the first vector quantizer 506, and the long-term prediction block 628 is coupled to the LTP analysis block 510 via the second vector quantizer 512 (connections also not shown).

The purpose of the noise shaping quantizer 516 is to quantize the LTP residual signal in a manner that weights the distortion noise created by the quantisation into less noticeable parts of the frequency spectrum, e.g. where the human ear is more tolerant to noise and/or where the speech energy is high so that the relative effect of the noise is less.

In operation, all gains and filter coefficients and gains are updated for every subframe, except for the LPC coefficients, which are updated once per frame. The noise shaping quantizer 516 generates a quantized output signal that is identical to the output signal ultimately generated in the decoder. The input signal is subtracted from this quantized output signal at the second subtraction stage 616 to obtain the quantization error signal d(n). The quantization error signal is input to a shaping filter 612, described in detail later. The output of the shaping filter 612 is added to the input signal at the first addition stage 602 in order to effect the spectral shaping of the quantization noise. From the resulting signal, the output of the prediction filter 614, described in detail below, is subtracted at the first subtraction stage 604 to create a residual signal. The residual signal is multiplied at the first amplifier 606 by the inverse quantized quantization gain from the noise shaping analysis block 514, and input to the scalar quantizer 608. The quantization indices of the scalar quantizer 608 represent an excitation signal that is input to the arithmetically encoder 518. The scalar quantizer 608 also outputs a quantization signal, which is multiplied at the second amplifier 609 by the quantized quantization gain from the noise shaping analysis block 514 to create an excitation signal. The output of the prediction filter 614 is added at the second addition stage to the excitation signal to form the quantized output signal. The quantized output signal is input to the prediction filter 614.

On a point of terminology, note that there is a small difference between the terms "residual" and "excitation". A residual is obtained by subtracting a prediction from the input speech signal. An excitation is based on only the quantizer output. Often, the residual is simply the quantizer input and the excitation is its output.

The shaping filter 612 inputs the quantization error signal d(n) to a short-term shaping filter 624, which uses the short-term shaping coefficients $a_{shape,i}$ to create a short-term shaping signal $s_{short}(n)$, according to the formula:

$$s_{short}(n) = \sum_{i=1}^{16} d(n-i)a_{shape,i}.$$

The short-term shaping signal is subtracted at the third addition stage 622 from the quantization error signal to create a shaping residual signal f(n). The shaping residual signal is input to a long-term shaping filter 620 which uses the long-term shaping coefficients $b_{shape,i}$ to create a long-term shaping signal $s_{long}(n)$, according to the formula:

$$s_{long}(n) = \sum_{i=-2}^{2} f(n-\text{lag}-i)b_{shape,i}.$$

The short-term and long-term shaping signals are added together at the third addition stage 618 to create the shaping filter output signal.

The prediction filter 614 inputs the quantized output signal y(n) to a short-term prediction filter 632, which uses the quantized LPC coefficients $a_i$ to create a short-term prediction signal $p_{short}(n)$, according to the formula:

$$p_{short}(n) = \sum_{i=1}^{16} y(n-i)a_i.$$

The short-term prediction signal is subtracted at the fourth subtraction stage 630 from the quantized output signal to create an LPC excitation signal $e_{LPC}(n)$. The LPC excitation signal is input to a long-term prediction filter 628 which uses the quantized long-term prediction coefficients $b_i$ to create a long-term prediction signal $p_{long}(n)$, according to the formula:

$$p_{long}(n) = \sum_{i=-2}^{2} e_{LPC}(n-\text{lag}-i)b_i.$$

The short-term and long-term prediction signals are added together at the fourth addition stage 626 to create the prediction filter output signal.

The LSF indices, LTP indices, quantization gains indices, pitch lags and excitation quantization indices are each arithmetically encoded and multiplexed by the arithmetic encoder 518 to create the payload bitstream. The arithmetic encoder 518 uses a look-up table with probability values for each index. The look-up tables are created by running a database of speech training signals and measuring frequencies of each of the index values. The frequencies are translated into probabilities through a normalization step.

Figure 7:
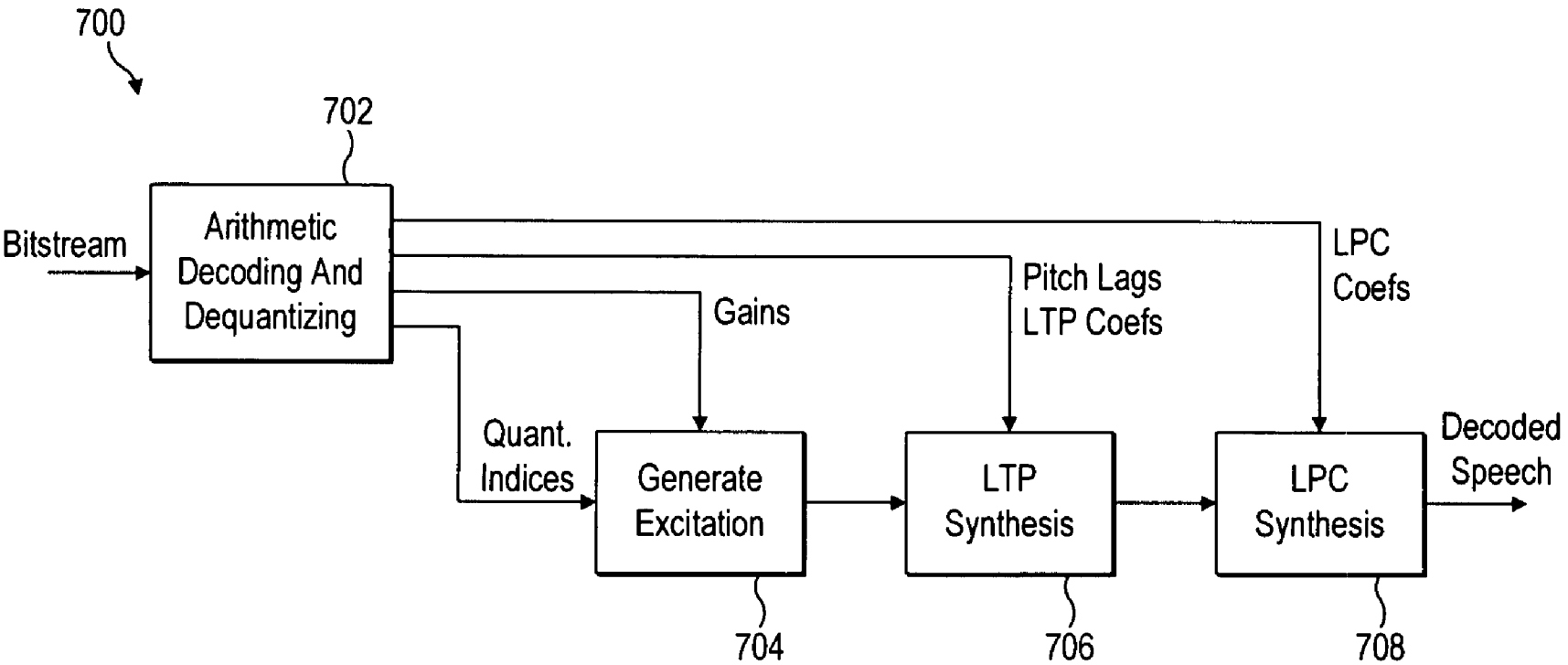
FIG. 7 is a schematic block diagram of a decoder.

An example decoder 700 for use in decoding a signal encoded according to embodiments of the present invention is now described in relation to FIG. 7.

The decoder 700 comprises an arithmetic decoding and dequantizing block 702, an excitation generation block 704, an LTP synthesis filter 706, and an LPC synthesis filter 708. The arithmetic decoding and dequantizing block 702 has an input arranged to receive an encoded bitstream from an input device such as a wired modem or wireless transceiver, and has outputs coupled to inputs of each of the excitation generation block 704, LTP synthesis filter 706 and LPC synthesis filter 708. The excitation generation block 704 has an output coupled to an input of the LTP synthesis filter 706, and the LTP synthesis block 706 has an output connected to an input of the LPC synthesis filter 708. The LPC synthesis filter has an output arranged to provide a decoded output for supply to an output device such as a speaker or headphones.

At the arithmetic decoding and dequantizing block 702, the arithmetically encoded bitstream is demultiplexed and decoded to determine the LTP codebook indicator 109 for each frame, and to create LSF indices, LTP indices, quantization gains indices, pitch lags and a signal of excitation quantization indices. The LSF indices are converted to quantized LSFs by adding the codebook vectors of the ten stages of the MSVQ. The quantized LSFs are transformed to quantized LPC coefficients. The LTP codebook indicator 109 is used to select an LTP codebook, which is then used to convert the LTP indices to quantized LTP coefficients. The gains indices are converted to quantization gains, through look ups in the gain quantization codebook.

At the excitation generation block, the excitation quantization indices signal is multiplied by the quantization gain to create an excitation signal e(n).

The excitation signal is input to the LTP synthesis filter 706 to create the LPC excitation signal $e_{LPC}(n)$ according to:

$$e_{LPC}(n) = e(n) + \sum_{i=-2}^{2} e(n - \text{lag} - i)b_i,$$

using the pitch lag and quantized LTP coefficients $b_i$.

The LPC excitation signal is input to the LPC synthesis filter to create the decoded speech signal y(n) according to:

$$y(n) = e_{LPC}(n) + \sum_{i=1}^{16} e_{LPC}(n - i)a_i,$$

using the quantized LPC coefficients $a_i$.

The encoder 500 and decoder 700 are preferably implemented in software, such that each of the components 502 to 632 and 702 to 708 comprise modules of software stored on one or more memory devices and executed on a processor. A preferred application of the present invention is to encode speech for transmission over a packet-based network such as the Internet, preferably using a peer-to-peer (P2P) system implemented over the Internet, for example as part of a live call such as a Voice over IP (VoIP) call. In this case, the encoder 500 and decoder 700 are preferably implemented in client application software executed on end-user terminals of two users communicating over the P2P system.

It will be appreciated that the above embodiments are described only by way of example. For instance, some or all of the modules of the encoder and/or decoder could be implemented in dedicated hardware units. Further, the invention is not limited to use in a client application, but could be used for any other speech-related purpose such as cellular mobile telephony. Further, instead of only selecting the codebook once per frame, in other embodiments a codebook could be selected less or more frequently, even up to once for each vector. Further, instead of a user input device like a microphone, the input speech signal could be received by the encoder from some other source such as a storage device and potentially be transcoded from some other form by the encoder; and/or instead of a user output device such as a speaker or headphones, the output signal from the decoder could be sent to another source such as a storage device and potentially be transcoded into some other form by the decoder. Other applications and configurations may be apparent to the person skilled in the art given the disclosure herein. The scope of the invention is not limited by the described embodiments, but only by the appended claims.

According to the invention in certain embodiments there is provided an encoder as therein described having the following features:

The second signal-processing module may be configured to quantize at least one of the vectors of said number of intervals according to each of said plurality of codebooks, and select the codebook based on comparison of said quantizations.

The second signal-processing module may be configured to quantize all of the vectors of said number of intervals according to each of said plurality of codebooks, and selecting the codebook based on comparison of said quantizations.

The second signal-processing module may be configured to perform said selection based on comparison of a distortion measure evaluated for the vectors of said number of intervals as quantized according to each of said codebooks.

The second signal-processing module may be configured to perform said comparison based on the distortion measure weighed against a bitrate required to encode the vectors of said number of intervals according to each codebook.

The second signal processing means may be configured to operate over a plurality of frames, each frame comprising a plurality of subframes; each of said intervals is a subframe; and said number may be the number of subframes per frame such that said selection is performed once per frame.

The number of intervals may be one.

The second signal-processing means may be configured to extract a signal comprising said vectors from the first remaining signal, thus leaving a second remaining signal, and to transmit parameters of the second remaining signal over the communication medium as part of said encoded signal.

The second signal-processing module may comprise a long-term prediction module.

The first signal-processing module may comprise a linear predictive coding module.

According to the invention in certain embodiments there is provided a decoder as described above heaving the feature of a signal processing means comprises a long-term prediction synthesis filter.

The invention claimed is:

1. A method of encoding speech according to a source-filter model whereby speech is modeled to comprise a source signal filtered by a time-varying filter, the method comprising:

receiving a speech signal;

from the speech signal, deriving a spectral envelope signal representative of the modeled filter and a first remaining signal representative of the modeled source signal;

at each of a plurality of intervals during the encoding, determining a period between portions of the first remaining signal having a degree of repetition and determining a correlation between said portions based on said period effective to produce a respective vector of the correlation for each interval, each vector comprising a plurality of parameters derived from the respective correlation;

once every number of said intervals, selecting a codebook from a plurality of codebooks for quantizing said vectors, quantizing the vectors of that number of intervals according to the selected codebook, and transmitting the quantized vectors along with an indication of the selected codebook over a transmission medium as part of an encoded signal representative of said speech signal.

2. The method of claim 1, wherein the selecting comprises quantizing at least one of the vectors of said number of intervals according to each of said plurality of codebooks, and selecting a codebook based on comparing said quantizations.

3. The method of claim 2, wherein the selecting comprises quantizing all of the vectors of said number of intervals according to each of said plurality of codebooks, and selecting a codebook based on comparing said quantizations.

4. The method of claim 2, wherein the selecting is based on comparing a distortion measure evaluated for the vectors of said number of intervals as quantized according to each of said codebooks.

5. The method of claim 4, wherein the comparing is based on the distortion measure weighed against a bitrate required to encode the vectors of said number of intervals according to each codebook.

6. The method of claim 1, wherein: the encoding is performed over a plurality of frames, each frame comprising a plurality of subframes; each of said intervals is a subframe; and said number is the number of subframes per frame such that said selecting is performed once per frame.

7. The method of claim 1, wherein said number is one.

8. The method of claim 1, further comprising:

extracting a signal comprising said vectors from the first remaining signal effective to leave a second remaining signal; and transmitting parameters of the second remaining signal over the communication medium as part of said encoded signal.

9. The method of claim 8, wherein the extracting of said second remaining signal from the first remaining signal is by long term prediction.

10. The method of claim 1, wherein the deriving of said first remaining signal from the speech signal is by linear predictive coding.

11. A method of decoding an encoded signal comprising speech encoded according to a source-filter model whereby the speech is modeled to comprise a source signal filtered by a time-varying filter, the method comprising:

receiving a encoded signal over a communication medium; at intervals during the decoding of said encoded signal, determining an index of a respective quantized vector from the encoded signal, each vector relating to a correlation between portions of the modeled source signal having a degree of repetition;

once every number of said intervals, determining an indicator of a codebook from the encoded signal, selecting the indicated codebook from a plurality of codebooks for said vectors, and determining, by using the selected codebook, the vectors of said number of intervals from their respective indices;

generating a decoded speech signal based on the determined vectors, and outputting the decoded speech signal to an output device.

12. The method of claim 11 wherein the decoding is performed over a plurality of frames, each frame comprising a plurality of subframes; each of said intervals is a subframe; and said number is the number of subframes per frame such that said determining and selecting are performed once per frame.

13. The method of claim 11, wherein said number is one.

14. The method of claim 11, wherein the generating of said decoded speech signal based on the determining of the vectors comprises using a long-term prediction synthesis filter.

15. An encoder for encoding speech according to a source-filter model whereby speech is modeled to comprise a source signal filtered by a time-varying filter, the encoder comprising:

an input arranged to receive a speech signal;

a first signal-processing module configured to derive, from the speech signal, a spectral envelope signal representative of the modeled filter and a first remaining signal representative of the modeled source signal;

a second signal-processing module configured to determine, at each of a plurality of intervals during the encoding, a period between portions of the first remaining signal having a degree of repetition and determine a correlation between said portions based on said period effective to produce a respective vector of the correlation for each interval, each vector comprising a plurality of parameters derived from the respective correlation;

wherein the second signal-processing module is further configured to select, once every number of said intervals, a codebook from a plurality of codebooks for quantizing said vectors, to quantize the vectors of that number of intervals according to the selected codebook, and to transmit the quantized vectors along with an indication of the selected codebook over a transmission medium as part of an encoded signal representative of said speech signal.

16. A decoder for decoding an encoded signal comprising speech encoded according to a source-filter model whereby the speech is modeled to comprise a source signal filtered by a time-varying filter, the decoder comprising:

an input module for receiving an encoded signal over a communication medium; and a signal-processing module configured to determine, at intervals during the decoding of said encoded signal, an index of a respective quantized vector from the encoded signal, each vector relating to a correlation between portions of the modeled source signal having a degree of repetition;

wherein the signal-processing module is further configured to determine, once every number of said intervals, an indicator of a codebook from the encoded signal, to select the indicated codebook from a plurality of codebooks said vectors, and to use the selected codebook to determine the vectors of said number of intervals from their respective indices; and the decoder further comprises an output module configured to generate a decoded speech signal based on the determined vectors, and output the decoded speech signal to an output device.

17. The decoder of 16, wherein: the signal-processing module is configured to operate over a plurality of frames, each frame comprising a plurality of subframes; each of said intervals is a subframe; and said number is the number of subframes per frame such that said determination and selection are performed once per frame.

18. The decoder of claim 16, wherein said number is one.

19. A computer-readable hardware storage media having computer-readable instructions that when executed encode speech according to a source-filter model whereby the speech is modeled to comprise a source signal filtered by a time-varying filter, the instructions arranged so as when executed on a processor to:

receive a speech signal;

from the speech signal, derive a spectral envelope signal representative of the modeled filter and a first remaining signal representative of the modeled source signal;

at each of a plurality of intervals during the encoding, determine a period between portions of the first remaining signal having a degree of repetition and determine a correlation between said portions based on said period effective to produce a respective vector of the correlation for each interval, each vector comprising a plurality of parameters derived from the respective correlation;

once every number of said intervals, select a codebook from a plurality of codebooks for quantizing said vectors, quantize the vectors of that number of intervals according to the selected codebook, and transmit the quantized vectors along with an indication of the selected codebook over a transmission medium as part of an encoded signal representative of said speech signal.

20. A computer-readable hardware storage media having computer-readable instructions which when executed decode an encoded signal comprising speech encoded according to a source-filter model whereby the speech is modeled to comprise a source signal filtered by a time-varying filter, the program comprising code arranged so as when executed on a processor to:

receive an encoded signal over a communication medium;

at intervals during the decoding of said encoded signal, determine an index of a respective quantized vector from the encoded signal, each vector relating to a correlation between portions of the modeled source signal having a degree of repetition;

once every number of said intervals, determine an indicator of a codebook from the encoded signal, select the indicated codebook from a plurality of codebooks said vectors, and use the selected codebook to determine the vectors of said number of intervals from their respective indices; and generate a decoded speech signal based on the determined vectors, and outputting the decoded speech signal to an output device.

* * * * *